US011109646B2

(12) United States Patent
Hortnagl

(10) Patent No.: US 11,109,646 B2
(45) Date of Patent: Sep. 7, 2021

(54) BUCKLE, IN PARTICULAR BELT BUCKLE

(71) Applicant: ABA Hortnagl GmbH, Fulpmes (AT)

(72) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 0 days.

(21) Appl. No.: 16/439,088

(22) Filed: Jun. 12, 2019

(65) Prior Publication Data

US 2019/0380453 A1 Dec. 19, 2019

(30) Foreign Application Priority Data

Jun. 13, 2018 (AT) ..... 173/2018
May 29, 2019 (EP) ..... 19177159

(51) Int. Cl.
*A44B 11/25* (2006.01)

(52) U.S. Cl.
CPC ..... *A44B 11/2511* (2013.01); *A44B 11/2561* (2013.01)

(58) Field of Classification Search
CPC ..... A44B 11/2511; A44B 11/2561; A44B 11/2584; A44B 11/26; A44B 11/2507; A44B 11/10; A44B 11/258; A44B 11/263; A44B 11/2519; A44B 11/253; A44B 11/2569
See application file for complete search history.

(56) References Cited

U.S. PATENT DOCUMENTS 3,523,341 A 8/1970 Spires
4,393,556 A 7/1983 Yuda et al.
4,949,436 A 8/1990 Anscher
6,704,977 B1 3/2004 Chung
6,965,231 B1 11/2005 Cinoglu et al.
7,114,225 B2 * 10/2006 Casebolt ..... A44B 11/253 24/634
D735,606 S * 8/2015 Grant ..... D11/218
(Continued)

FOREIGN PATENT DOCUMENTS

DE 50310029 6/2007
DE 102006004852 8/2007
(Continued)

OTHER PUBLICATIONS

Buckle (admitted prior art), Apr. 12, 2018.

*Primary Examiner* — Robert Sandy
*Assistant Examiner* — Rowland Do
(74) *Attorney, Agent, or Firm* — Volpe Koenig

(57) ABSTRACT

A buckle with a first buckle part and at least one second buckle part. The first buckle part has a first buckle main body and a receptacle which is hook-shaped, seen in at least one section, and formed rigidly on the first buckle main body. The second buckle part has a second buckle main body with an inherently rigid hook-in part for hooking into the receptacle of the first buckle part, and the first buckle part additionally has at least one bolt. The hook-in part has a central web and two side parts protruding on mutually opposite sides from the central web, and each of the side parts is delimited by a respective front edge, and the front edges of the side parts are oriented extending obliquely away from each other at least regionally from a direction of the central web, preferably running at least regionally in a V-shape relative to each other.

16 Claims, 7 Drawing Sheets

(56) References Cited

U.S. PATENT DOCUMENTS

| | | | | |
|---|---|---|---|---|
| 9,993,048 | B2 * | 6/2018 | Casebolt | A44B 11/2592 |
| 2002/0184742 | A1 * | 12/2002 | Casebolt | A44B 11/253 24/634 |
| 2004/0078943 | A1 | 4/2004 | Hede et al. | |
| 2006/0048350 | A1 * | 3/2006 | Coulombe | A44B 11/253 24/634 |
| 2009/0013510 | A1 | 1/2009 | Liang | |
| 2010/0071173 | A1 * | 3/2010 | Hortnagl | A44B 11/2592 24/651 |
| 2012/0000041 | A1 | 1/2012 | Hede | |
| 2014/0082902 | A1 * | 3/2014 | Hortnagl | A44B 11/2519 24/664 |
| 2015/0089777 | A1 * | 4/2015 | Hung | A44B 11/2511 24/593.1 |
| 2015/0135486 | A1 * | 5/2015 | Fiedler | A44B 11/2584 24/303 |
| 2017/0000219 | A1 * | 1/2017 | Moran | A44B 11/2569 |
| 2017/0000220 | A1 * | 1/2017 | Moran | A44B 11/266 |
| 2019/0022436 | A1 | 1/2019 | Emonin | |

FOREIGN PATENT DOCUMENTS

| | | |
|---|---|---|
| EP | 2401933 | 1/2012 |
| EP | 2944216 | 11/2015 |
| FR | 1523727 | 5/1968 |
| JP | 2015195839 | 11/2015 |
| KR | 101860271 | 5/2018 |

* cited by examiner

BUCKLE, IN PARTICULAR BELT BUCKLE

INCORPORATION BY REFERENCE

The following documents are incorporated herein by reference as if fully set forth: Austrian Patent Application No. A 173/2018, filed Jun. 13, 2018; and European Patent Application No. 19177159.1, filed May 29, 2019.

BACKGROUND

The present invention relates to a buckle, in particular a belt buckle, with a first buckle part and at least one second buckle part, wherein the first buckle part has a first buckle main body and a receptacle which is hook-shaped, seen in at least one section, and formed rigidly on the first buckle main body, and the second buckle part has a second buckle main body with an inherently rigid hook-in part for hooking into the receptacle of the first buckle part, and the first buckle part additionally has at least one bolt, wherein the hook-in part, in a state when hooked into the receptacle in a locking position of the bolt, is retained in the receptacle by at least one retaining surface of the bolt and, in an unlocking position of the bolt, is removable from the receptacle.

Buckles of this kind have the advantage that, by virtue of the rigid design of the hook-shaped receptacle of the first buckle part and the rigid design of the hook-in part of the second buckle part, a buckle can be created that is very stable in a pulling direction. A buckle of the type in question is shown, for example, in FIGS. 4a and 4b of DE 10 2006 004 852 A1.

A disadvantage of these buckles known per se is that, while being stable in the pulling direction in which the first buckle part and the second buckle part are pulled away from each other, they do not very effectively prevent a tilting movement of the two buckle parts relative to each other.

SUMMARY

The object of the present invention is to provide an improvement in this respect to a buckle of the abovementioned type.

To achieve this object, the invention provides that the hook-in part has a central web and two side parts protruding on mutually opposite sides from the central web, and each of the side parts is delimited by a respective front edge, and the front edges of the side parts are oriented running obliquely away from each other at least regionally from the direction of the central web, preferably running at least regionally in a V-shape relative to each other.

By virtue of the front edges and therefore also side parts of the hook-in part running obliquely away from each other at least regionally from the direction of the central web, it is possible, on the one hand, to obtain a buckle which has a relatively short overall length and in which, on the other hand, by virtue of the special design of the side parts and their front edges, the two buckle parts in the state when hooked into each other are secured quite effectively against a titling movement in a direction orthogonal to the pulling direction.

The front edges are the edges which delimit the side parts and which, when the hook-in part is pulled in a pulling direction, face into the receptacle. These front edges can be straight or else curved. Particularly preferably, the front edges of the two side parts protruding on opposite sides of the central web are oriented in a V-shape relative to each other at least regionally. The front edges, or else only subregions of the front edges, expediently run at an acute or obtuse angle in the direction toward the central web.

In particularly preferred variants of the invention, provision is made that the side parts together form a dovetail shape, if appropriate along with the central web. As the entire hook-in part is inherently rigid, the side parts are also necessarily formed rigidly on the central web. The central web and the two side parts together form the hook-in part, although it is not excluded that the hook-in part has further components. The hook-in part is at any rate a part of the second buckle main body of the second buckle part. The second buckle main body can have, in addition to the hook-in part, for example a belt web for winding a belt around, and a corresponding belt-receiving slot through which the belt is inserted. The belt web can be rigid, or it can also be designed as a movable, in particular displaceable, belt web for clamping a belt on the second buckle main body. The second buckle main body as a whole can be an inherently rigid component, or it can also have movable parts, e.g. a displaceably mounted belt web.

The hook-shaped receptacle of the first buckle part, as seen in at least one section, is often referred to below simply as receptacle, for the sake of brevity. This receptacle is formed rigidly on the first buckle main body. In addition to the receptacle, the first buckle main body can likewise have a belt web and a belt-receiving slot. Here too, the belt web can be rigid, or it can also be designed as a movable, in particular displaceable, clamping web on the first buckle main body.

The bolt is arranged movably, between its locking position and its unlocking position, on the first buckle main body. In the state with the hook-in part hooked into the receptacle, the bolt in its locking position can, with the retaining surface, secure the hook-in part in the receptacle, such that the two buckle parts cannot accidentally separate from each other. Separation of the two buckle parts is possible only when the bolt has been brought to its unlocking position. In the unlocking position, the hook-in part can then be removed from the receptacle in order thereby to separate the two buckle parts from each other.

In principle, buckles according to the invention can be very differently configured and can also serve very different tasks. In principle, they serve to connect to component parts to each other in a releasable manner. Buckles according to the invention are particularly preferably what are called belt buckles, which serve to connect a belt to another belt or a belt to another component. Accordingly, possibilities are then also provided, e.g. said belt webs, on the buckle parts to which the belts can be fastened. Instead of a belt web, however, other fastening possibilities can also be provided, or in other words other connection possibilities, e.g. fastening holes on the buckle parts. These other fastening possibilities can then likewise be used to fasten belts or, if it is not a belt buckle, other objects. In the case of a belt buckle, the belt webs of the buckle parts can also be of different lengths in order to be able to connect belts with different widths to each other. The widths of the buckle parts can of course also be adapted to the belt widths of the belts that are to be connected to each other. Provision is preferably made that each of the side parts, on a side opposite the respective front edge of the side part, is delimited by a rear edge of the side part, and the at least one retaining surface of the bolt in the locking position forms an abutment surface for the rear edges of the side parts of the hook-in part hooked into the receptacle.

In particularly preferred variants, provision is made that the rear edges of the side parts are oriented running obliquely away from each other at least regionally from the direction of the central web, preferably running at least regionally in a V-shape relative to each other. The rear edges can also be straight or else curved.

In preferred variants of the invention, provision is made that the front edges of the side parts together enclose an angle in an angle range of 20° to 160°, preferably of 60° to 120°. In preferred embodiments, a similar situation also applies to the rear edges of the side parts. These too enclose an angle preferably in an angle range of 20° to 160°, particularly preferably of 60° to 120°. In the case of front edges and/or rear edges that are oriented running obliquely away from each other only regionally from the direction of the central web, these angle indications then preferably apply only to the regions running obliquely away from each other.

In particularly preferred variants of the invention, provision is made that only a subregion of the respective front edge is formed as a contact shoulder on the hook-in part, and corresponding mating contact shoulders are formed on the first buckle main body, wherein, in the state with the hook-in part hooked in the receptacle, when the hook-in part is pulled in a pulling direction into the receptacle, the tensile forces in the pulling direction can be transmitted from the hook-in part to the first buckle main body exclusively via the bearing of the contact shoulders on the mating contact shoulders. In such embodiments, the tensile forces acting on the two buckle parts in the pulling direction are transmitted exclusively via the bearing of the contact shoulders on the corresponding mating contact shoulders. In the hooked-in state in the receptacle, the remaining regions of the front edge of the respective side part of the hook-in part are free, such that no forces can be transmitted via these from one buckle part to the other buckle part in the pulling direction. Since the regions of the front edges lying outside the contact shoulder are thus free, albeit only in the pulling direction, a spreading effect exerted by the front edges of the side parts, running obliquely away from each other, in particular in a V shape, on the first buckle part or the receptacle can be prevented. Through the interaction with the receptacle, the side parts then mainly serve to secure the two buckle parts against tilting relative to each other about an axis orthogonal to the pulling direction. In this sense, provision is expediently made that the contact shoulders are each arranged in a half of the respective front edge pointing toward the central web. Preferably, the contact shoulders in each case directly adjoin the central web. The contact shoulders can each be formed as an at least regionally rounded undercut. As has already been indicated, in the state with the hook-in part hooked in the receptacle, the side walls of the receptacle of the first buckle main body preferably form side abutments for the front edges of the side parts, for preventing lateral tilting of the hook-in part out of the receptacle in a direction orthogonal to the pulling direction.

Preferably, the bolt in the first buckle main body is configured as a push button which is displaceable preferably exclusively linearly between the locking position and the unlocking position. Of course, it is also possible for more than one bolt to be provided. Moreover, the one or more bolts do not necessarily have to be designed as push buttons. For example, one or more pivotably mounted levers could also be provided as bolts. It is expedient, however, if the bolt is elastically pretensioned in the direction toward its locking position. For this purpose, the bolt can be inherently elastic or it can be elastically pretensioned via a corresponding pretensioning element, e.g. a spring or an elastomer body.

In preferred embodiments, the bolt is step-shaped. A first step of the bolt can have at least one retaining surface for the hook-in part in the locking position. A second step of the bolt, offset relative to the first step, can have a centering surface for centering, or in other words aligning, the hook-in part during insertion of the hook-in part into the receptacle. This centering surface expediently has a shape which corresponds to the rear edges of the hook-in part and which ensures that the centering surfaces, in their interaction with the hook-in part, preferably with the rear edges of the hook-in part, ensure that the hook-in part is automatically centered or aligned in the hooking-in procedure and is thus brought to a position from which the hook-in part can then be easily pulled or pushed into the receptacle. The centering surface and the corresponding contact surfaces, preferably rear edges, of the hook-in part can have very different configurations, as long as they interact with one another correspondingly in the sense of the centering action or aligning. For example, the centering surfaces, like the corresponding contact surfaces, in particular rear edges, can have regions running obliquely away from each other and in particular arranged in a V-shape. For the sake of completeness, it is noted that, during the insertion of the hook-in part into the receptacle, the centering surfaces can interact not necessarily just with the rear edges but also with other contact surfaces of the hook-in part.

To make it easier to insert the hook-in part into the receptacle, provision can be made that bevels serving as insertion aids for inserting the hook-in part into the receptacle are configured on the front edges of the side parts and/or on side walls of the first buckle main body that form the receptacle. These bevels or oblique surfaces can be configured such that, upon insertion of the hook-in part into the receptacle, the bolt is not separately actuated but is instead pressed automatically from its locking position into the unlocking position, such that the hook-in part can be inserted past it into the receptacle.

In the hooked-in state, and when the bolt is located in its locking position, the hook-in part is at any rate expediently arranged in a receiving opening of the first buckle main body, preferably open toward the side, and in the receptacle and/or is blocked between the receptacle and the bolt or the retaining surface thereof. To separate the buckle parts, the hook-in part can preferably be removed from the receptacle only when the bolt is deliberately brought to its unlocking position, preferably by manual actuation.

BRIEF DESCRIPTION OF THE DRAWINGS

To explain further preferred features of buckles according to the invention, reference is made by way of example to the following description of the figures, in which:

FIGS. 14 to 18 show the further steps of the hooking-in procedure leading up to the hooked-in and locked state, wherein FIGS. 14 and 16 show sections along the section lines HH from FIG. 18, and FIGS. 15 and 17 show sections along the section line II from FIG. 18;

DETAILED DESCRIPTION

Figure 1:
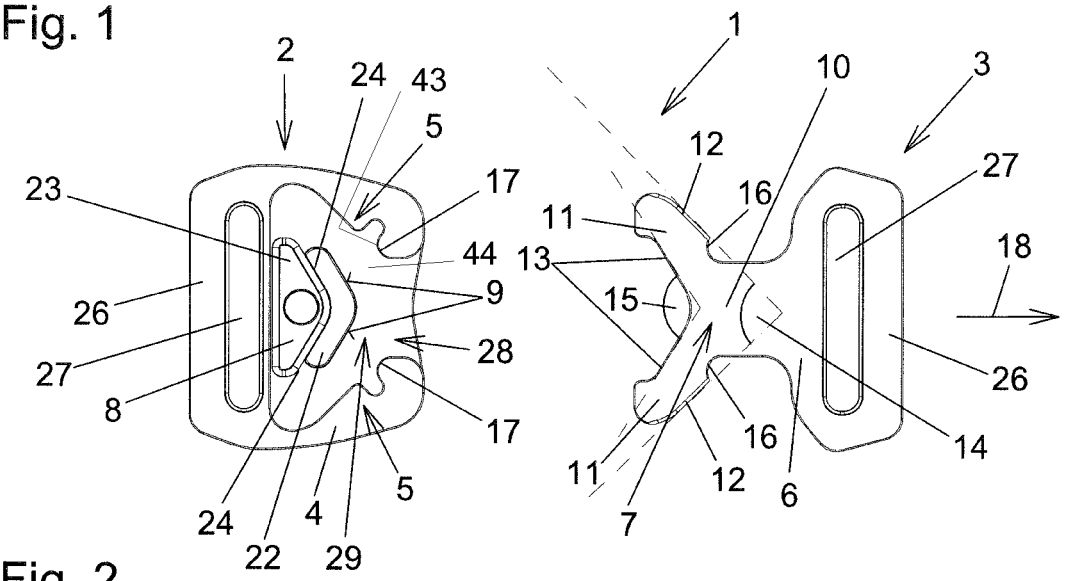
FIGS. 1 and 2 show the first and second buckle part of a preferred illustrative embodiment of a belt buckle according to the invention, in the state separated from each other.
Figure 2:
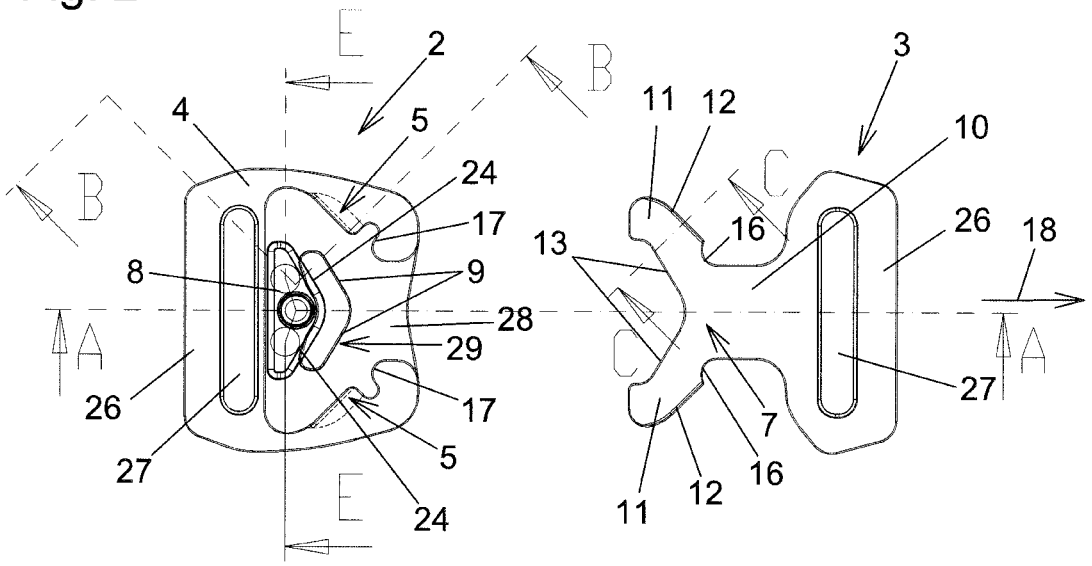

In FIGS. 1 and 2, the first illustrative embodiment depicted here of a buckle 1 according to the invention is shown in a state in which the first buckle part 2 and the second buckle part 3 are separated from each other. In the present illustrative embodiment, the buckle 1 is what is called a belt buckle. Belts can be secured on the respective belt webs 26. For this purpose, the belts are guided through the belt-receiving slot 27 and are then sewn in a manner known per se or secured in some other way. However, as has already been explained at the outset, buckles 1 according to the invention do not necessarily have to be belt buckles.

Buckles 1 according to the invention can also be used to connect other things releasably to each other. Even in the case of the design as a belt buckle, in particular the belt webs 26 and the belt-receiving slots 27 can of course be very different and, above all, other than as shown here. For example, as is known per se, the belt webs 26 can be in the form of displaceably mounted clamping webs or the like.

In the illustrative embodiment shown here, the second buckle part 3 has a second buckle main body 6 produced in one piece. A part of this second buckle main body 6 is the hook-in part 7. The hook-in part 7 comprises the central web 10 and also the two side parts 11 protruding from the central web 10 on mutually opposite sides. The hook-in part 7 is designed in one piece and is inherently rigid. This means, among other things, that the side parts 11 are arranged rigidly on the central web 10. Each of the side parts 11 is delimited by a respective front edge 12. According to the invention, the front edges 12 of the side parts 11 are oriented running obliquely away from each other from the direction of the central web 10. In the illustrative embodiment specifically shown here, the angle 14 that the front edges 12 of the side parts 11 enclose is ca. 90°. For the sake of completeness, it will be noted that an angle of 90°, i.e. a right angle, is also regarded as oblique. It was already explained at the outset that this angle 14 can of course also assume other values. The side parts 11 together form a dovetail shape. In the illustrative embodiments here, the rear edges 13 of the side parts 11, present on a side opposite the respective front edge 12 of the side part 11, are also oriented running obliquely away from each other starting from the central web 10. In the present example, the front edges 12 run at least regionally in a V-shape relative to each other. In the illustrative embodiment shown, the same applies to the rear edges 13. The angle 15 formed here between the rear edges 13 is ca. 120°.

In the hook-in part 7 realized here, provision is made that only a subregion of the respective front edge 12 is formed as a contact shoulder 16. In the illustrative embodiment shown here, the contact shoulders 16 each directly adjoin the central web 10. As is explained in more detail below with reference to FIG. 19, the contact shoulders 16 serve to transmit the tensile forces acting in pulling direction 18 directly to the mating contact shoulders 17 of the first buckle part 2, such that the remaining regions of the front edges 12 are unstressed with respect to the tensile forces acting in pulling direction 18.

The first buckle part 2 has a first buckle main body 4, which is here likewise configured in one piece and inherently rigid. As has already been stated, parts of this first buckle main body are the belt web 26 and the belt-receiving slot 27, which, as has been explained, can also be configured differently than set out here.

The first buckle main body 4 has an inherently rigid receptacle 5 defined by a rigid wall 43 extending up from a bottom wall 44, and the receptacle 5 is hook-shaped, seen in at least one section, and into which the hook-in part 7 of the second buckle part 3 can be hooked. The hook-shaped configuration of the receptacle 5 can be clearly seen for example in the section along the section line BB from FIG. 2, i.e. in FIG. 4. In order to ensure that the hook-in part 7 hooked into the receptacle 5 is secured against being accidentally taken out or falling out, a bolt 8 is provided thereon movably relative to the first buckle main body 4. In the illustrative embodiment shown here, the bolt 8 is designed as a push button which is displaceable exclusively linearly between the locking position and the unlocking position. The bolt 8 is elastically pretensioned in a direction 21. The bolt 8 has, inter alia, the retaining surfaces 9 with which the hook-in part 7, in the state when hooked into the receptacle, is secured in the locking position of the bolt 8. To be able to hook the hook-in part 7 into the receptacle 5, the first buckle main body 4 has, in preferred embodiments like the one shown here, a receiving opening 29 that is open to one side. The hook-in part 7 can be introduced into this receiving opening 29 in order to be hooked into the receptacle 5 and to be secured by the bolt 8, when the bolt 8 is in the locking position. The hooking-in procedure is explained in more detail below with reference to FIGS. 9 to 18.

In preferred variants like the one shown here, the first buckle main body has a central channel 28 for receiving the central web 10 of the second buckle part 3. A subregion of the receptacle 5 is located on both sides of the central channel 28. This is also a preferred configuration that is possible not only in this illustrative embodiment. In the invention, it is of course also possible in principle for several hook-shaped receptacles 5 to be present.

The mating contact shoulders 17 formed likewise on the first buckle main body 4 have already been mentioned. Their function is explained further below with reference to FIG. 19.

Figure 3:
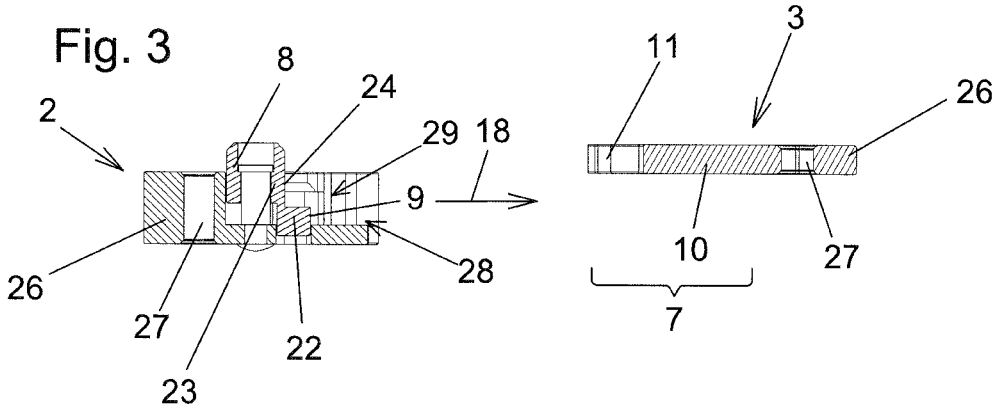
FIG. 3 shows the section along the section line AA from FIG. 2.
Figure 4:
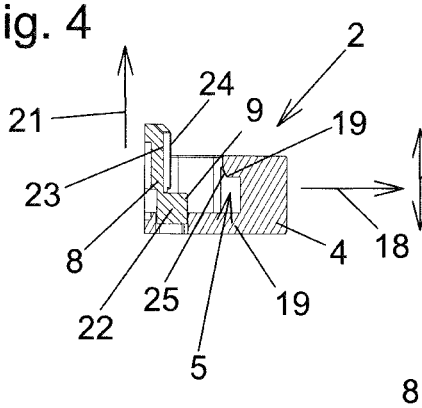
FIG. 4 shows the section along the section line BB from FIG. 2.

FIG. 3 shows the section along the section line AA through the two buckle parts 2 and 3. It can be seen particularly clearly from this figure that the bolt 8 in this embodiment, as in other preferred embodiments, has a stepped configuration. A first step 22 of the bolt 8 has the at least one retaining surface 9 for the hook-in part 7 in the locking position. A second step 23 of the bolt is offset in relation to the first step 22 and has a centering surface 24 for centering or aligning the hook-in part 7 during the insertion of the hook-in part 7 into the receptacle 5. As has been stated, FIG. 4 shows the section through the first buckle part 2 along the section line BB from FIG. 2. It can be seen particularly clearly from this that the receptacle 5 is hook-shaped in cross section and has two side walls 19. It can also be clearly seen that the receptacle 5 is inherently rigid.

Figure 5:
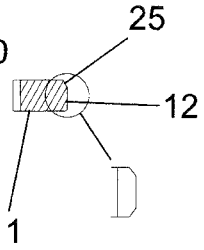
FIG. 5 shows the section along the section line CC from FIG. 2.
Figure 6:
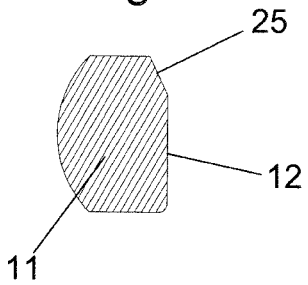
FIG. 6 shows the region D from FIG. 5 in an enlarged view.
Figure 8:
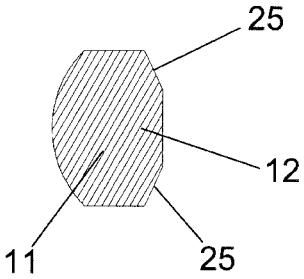
FIG. 8 shows an alternative embodiment in a view corresponding to FIG. 6.
Figure 9:
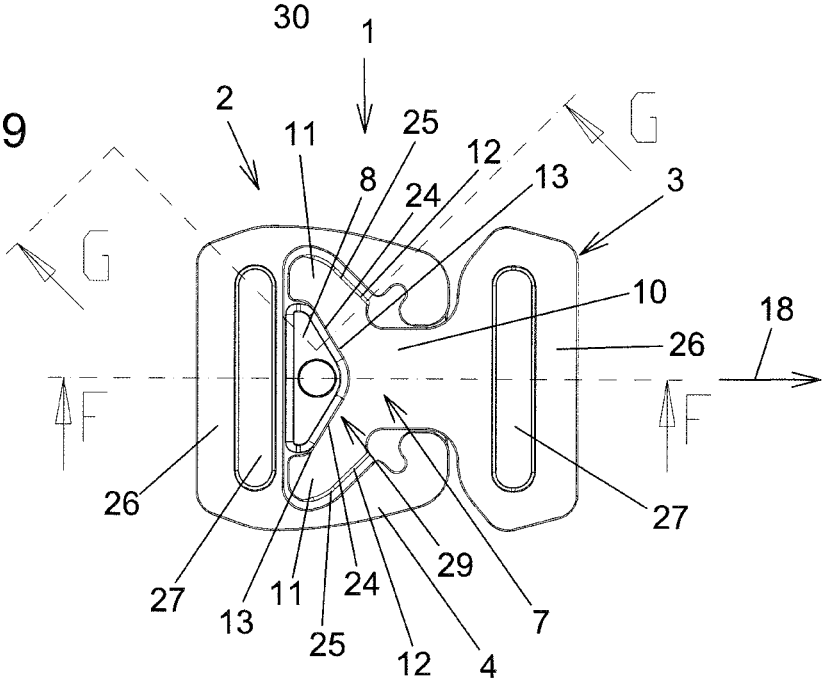
FIG. 9 shows the two buckle parts at the start of a hooking-in procedure.

FIG. 5 shows the section along the section line CC through one of the side parts 11 of the hook-in part 7 of the second buckle part 3. The area D of FIG. 5 is shown enlarged in FIG. 6. The bevel 25 formed on the front edge 12 of the side part 11 can be seen particularly clearly in FIG. 6, which bevel 25 constitutes an insertion aid when connecting the two buckle parts 2 and 3. By means of the bevel 25, the buckle 1 according to the invention can be configured such that, when hooking the hook-in part 7 into the receptacle 5, it is not necessary to actuate the bolt 8 by hand. FIG. 8 shows an alternative to FIG. 6, wherein a corresponding bevel 25 is formed there both on the top side and on the underside of the front edge 12. It will be seen from FIG. 4 that a corresponding bevel 25 can also be formed, for example, on the side wall 19 of the receptacle 5 toward the opening. This is also a possibility of configuring the buckle 1 according to the invention such that the two buckle parts 2 and 3 can be hooked into each other without separate actuation of the bolt 8.

Figure 7:
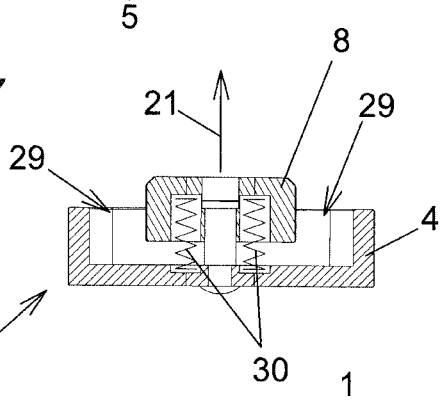
FIG. 7 shows a section along the section line EE from FIG. 2.

FIG. 7 shows the section along the section line EE from FIG. 2 through the first buckle main body 4 and the bolt 8. The bolt 8 is elastically pretensioned in the direction 21 toward its locking position. In the illustrative embodiment specifically shown, this is effected by two pretensioning elements 30, here designed as helical springs, which press the bolt 8 into its locking position as long as there are no corresponding counterforces. The restoring forces applied by the pretensioning elements 30 can be overcome by correspondingly pressing on the bolt 8 counter to the direction 21, such that the bolt 8 is then pressed linearly downward into its unlocking position. Of course, this kind of pretensioning can also be realized in another way than that specifically shown here. The pretensioning elements 30 do not have to be helical springs. Other elastic bodies can also be used accordingly. It is of course also not necessary for the number of pretensioning elements 30 to be two. A single pretensioning element 30 is also conceivable, or more than two pretensioning elements 30. It would also be possible in principle that a separate pretensioning element 30 is not needed at all, if the bolt 8 has corresponding pretensioning within itself.

Figure 10:
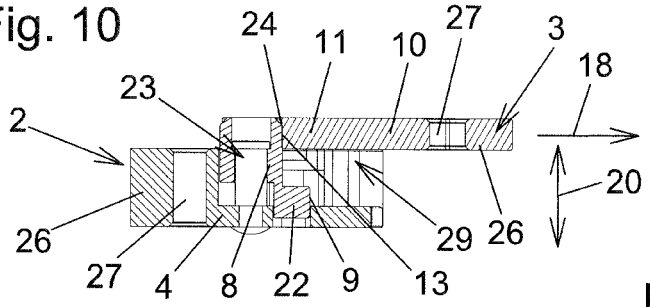
FIGS. 10 and 12 show two different positions in section along the section line FF at the start of the hooking-in procedure.
Figure 11:
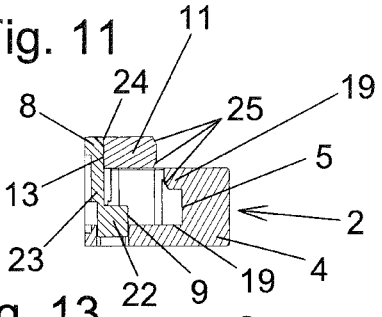
FIGS. 11 and 13 show two different positions in section along the section line GG at the start of the hooking-in procedure.
Figure 12:
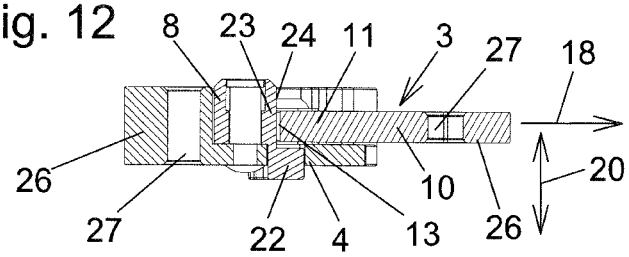
Figure 13:
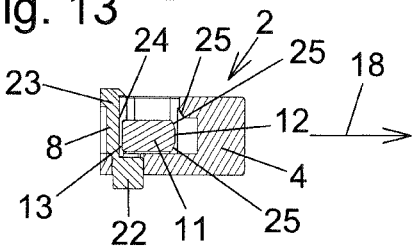

With reference to FIGS. 9 to 18, the procedure of hooking and locking the hook-in part 7 of the second buckle part 3 in the receptacle 5 of the first buckle part 2 is now explained. FIGS. 9 to 18 show this procedure step by step. FIGS. 10 and 12 show the section along the section line FF from FIG. 9. FIGS. 11 and 13 show the section GG from FIG. 9. The subsequent steps are described with reference to FIGS. 14 to 17, wherein FIGS. 14 and 16 each show the section along the section line HH and FIGS. 15 and 17 each show the sections along the section line II.

In the procedure of hooking the hook-in part 7 of the second buckle part 3 into the receptacle 5 of the first buckle part 2, first of all the hook-in part 7 is brought into line with the receiving opening 29 as shown in FIGS. 10 and 11. The centering surfaces 24 of the second step 23 of the bolt 8 ensure a corresponding alignment or centering of the hook-in part 7 relative to the receiving opening 29, since the centering surfaces 24 in this illustrative embodiment interact with the rear edges 13 with form-fit engagement. In the present case, the centering surfaces 24 have a kind of triangular shape or wedge shape corresponding to the rear edges 13. Of course, the centering surfaces 24 and also the corresponding rear edges 13 of the side parts 11 can be differently configured to achieve the same centering or aligning effect. It is also conceivable in principle that the centering surfaces 24 engage on regions of the side parts 11 or of the central web 10 other than on the rear edges 13.

Figure 14:
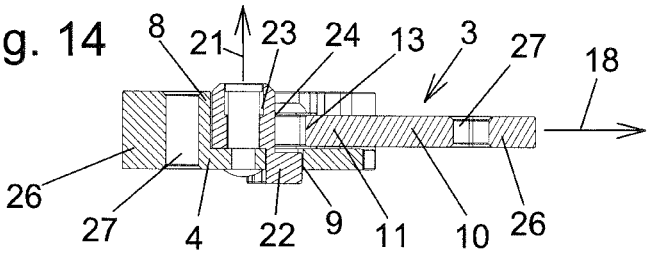
Figure 15:
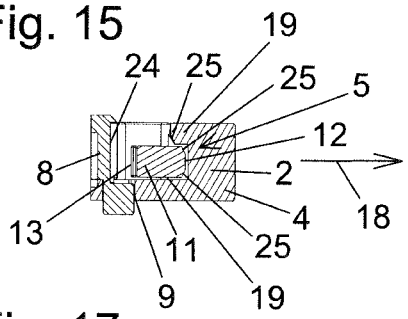
Figure 16:
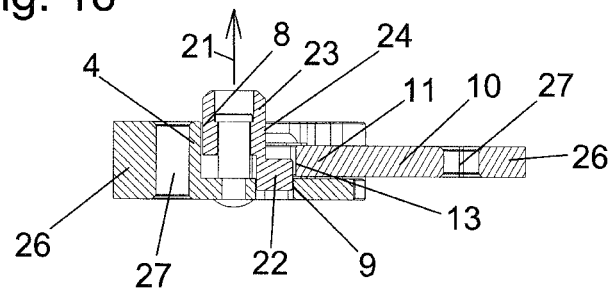
Figure 17:
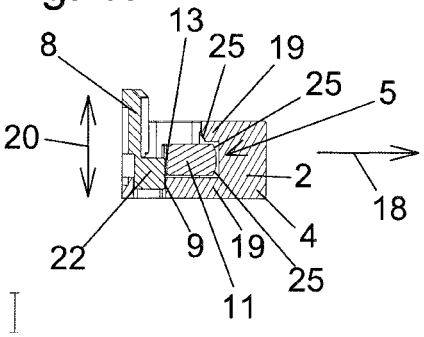

Proceeding from the position according to FIGS. 10 and 11, the hook-in part 7 is then at any rate pushed so far into the receiving opening 29 in a corresponding direction 20 orthogonal to the pulling direction 18 that it abuts the first step 22 of the bolt 8. By further movements of the hook-in part 7 or by corresponding pressing on the bolt 8, the latter can then be brought into the position according to FIGS. 12 and 13, in which the front edges 12 of the side parts 11 are made congruent with the opening of the receptacle 5. By subsequent pulling in pulling direction 18, the front edges 12 and if appropriate also further regions of the respective side parts 11 are pulled into the receptacle 5, as is shown in FIGS. 14 and 15. In this way, the first step 22 of the bolt 8 comes free, such that the pretensioning elements 30 or the elastic pretensioning of the bolt 8 press it in the direction 21 toward the locking position. When the locking position shown in FIGS. 16 and 17 is reached, the retaining surfaces 9 of the bolt 8 keep the hook-in part 7 locked in the receptacle 5, since the retaining surfaces 9 of the bolt 8 serve as abutments for the rear edges 13 of the hook-in part 7 and its side parts 11. This prevents the hook-in part 7 from inadvertently being taken out of the receptacle 5 or from otherwise accidentally falling out. The hook-in part 7 is then as it were blocked between the bolt 8 in its locking position and the receptacle 5.

In the described hooking-in procedure, the bevels 25 that are preferably present can serve as corresponding oblique surfaces which ensure that, by pulling on the second buckle part 3 in pulling direction 18, its hook-in part 7 is brought automatically from the position according to FIGS. 10 and 11 to the position according to FIGS. 12 and 13 and then to the position according to FIGS. 14 and 15. In these cases, therefore, no pressure or at least less pressure has to be applied to the bolt 8, or correspondingly to the second buckle part 3, counter to the direction 21.

Figure 18:
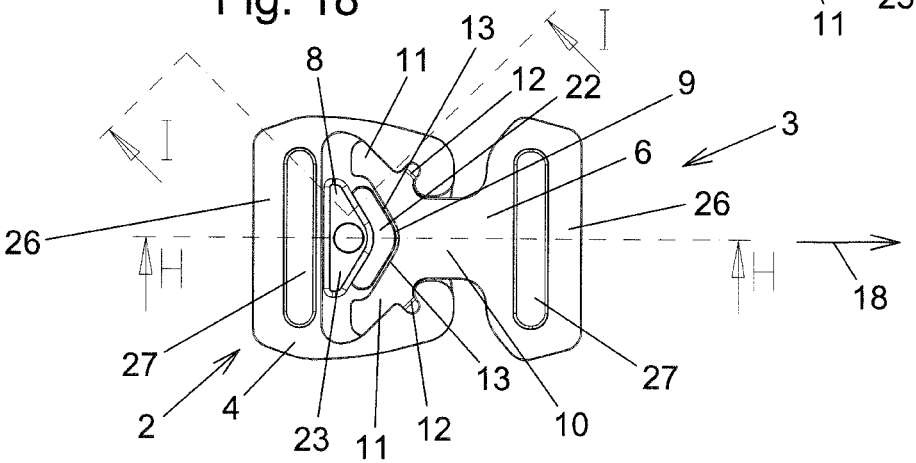

It can also be clearly seen in FIG. 18 how the hook-in part 7 is arranged with the front edges 12 of the side parts 11 in the receptacles 5, such that in this hooked-in and locked position according to FIG. 18 the hook-in part 7 can be removed from the receptacles 5, for separation of the two buckle parts 2 and 3, only if the bolt 8 has first been pressed from its locking position according to FIGS. 16 and 17 into its unlocking position according to FIGS. 14 and 15. The unhooking procedure thus takes place in the reverse sequence, from FIGS. 16 and 17 to FIGS. 10 and 11, followed by the second buckle part 3 finally being withdrawn from the first buckle part 1.

Figure 19:
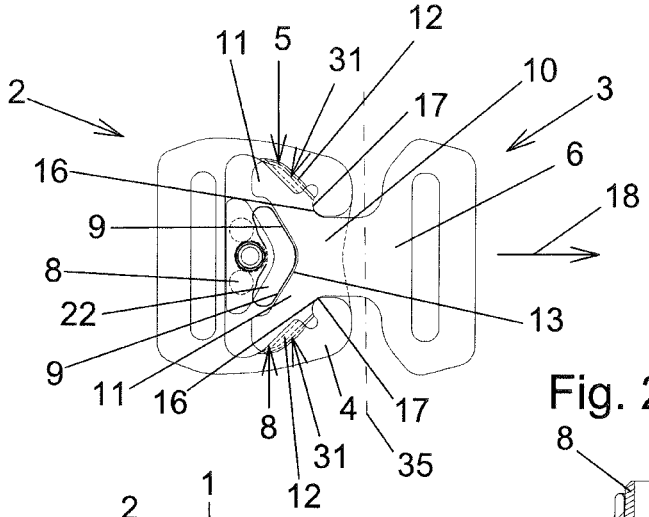
FIG. 19 shows the hook-in and locked state.

FIG. 19 likewise shows the fully hooked-in and locked state in which the side parts 11 are mounted with their front edges 12 in the receptacle 5, shown transparently in part in FIG. 19, and the retaining surfaces 9 of the bolt 8 form abutments for the corresponding rear edges 13 of the side parts 11. In this preferred illustrative embodiment, the contact shoulders 16 already mentioned in the introduction are the only surfaces of the hook-in part 7 which, during pulling in pulling direction 17, support the second buckle part 3 in pulling direction 18 on the first buckle part 2 and there in particular on the mating contact shoulders 17. By way of the other regions of the front edges 12, no forces are transmitted to the receptacle 5 in this pulling direction. In this embodiment, and also in other preferred embodiments, this is achieved by the fact that, when the contact shoulders 16 bear on the mating contact shoulders 17, a free space 31 in each case remains in front of the remaining regions of the front edges 12 in the receptacle 5, such that no forces can be transmitted in pulling direction 18 in the regions of the free spaces 31. In this way, as has already been explained in the introduction, a spreading action of the side parts 11 on the receptacle 5 or on the first buckle main body 4 is avoided. However, in this position according to FIG. 19, the front edges 12 or side parts 11 located in the corresponding subregions of the receptacle 5 prevent the hook-in part 2 or the entire second buckle part 3 from being able to be laterally tilted or released from the first buckle part 2 or the receptacle 5 thereof. The engagement of the front edges 12 in the receptacle 5 thus prevents a pivoting out or tilting out of the hook-in part 7 from of the receptacles about an imaginary axis 35 extending orthogonally to the pulling direction 18 in the drawing plane according to FIG. 19. In other words, the side walls 19 of the receptacle 5 of the first buckle main body 4, as side abutments for the front edges 12 of the side parts 11, prevent a lateral tilting of the hook-in part 7 out of the receptacle 5 in a direction 20 orthogonal to the pulling direction 18, wherein the direction 20 is also orthogonal to the drawing plane of FIG. 19 (see FIG. 12).

Figure 20:
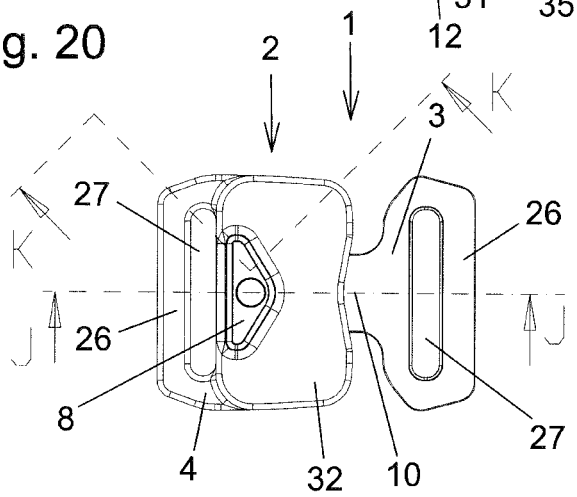
FIGS. 20 to 22 show an illustrative embodiment of a buckle according to the invention with a first form of a cover.
Figure 21:
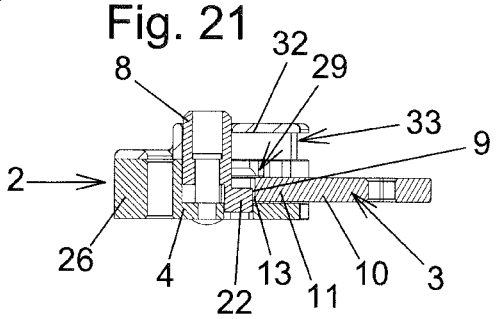
Figure 22:
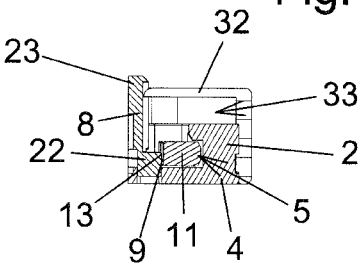
Figure 23:
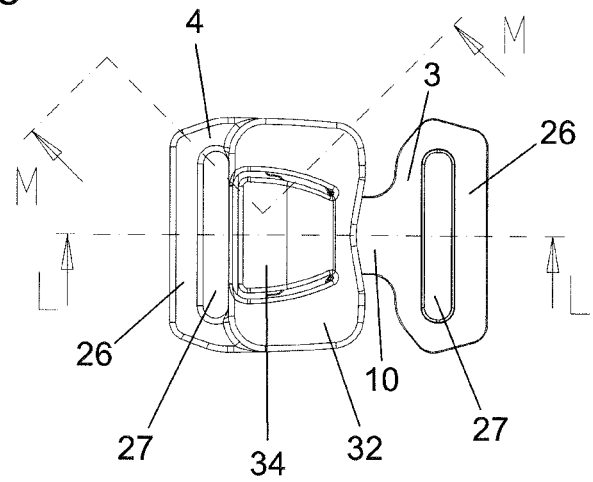
FIGS. 23 to 25 show a further embodiment of the invention with another cover.
Figure 24:
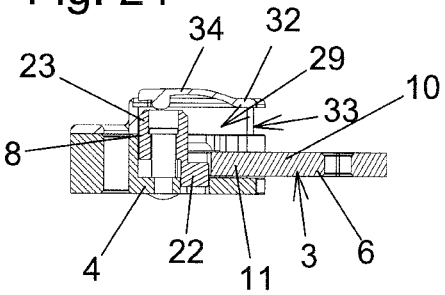
Figure 25:
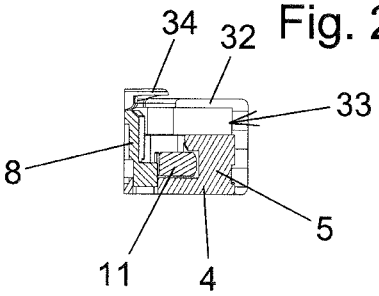

Whereas in the first illustrative embodiment according to FIGS. 1 to 19 the receiving opening 29 of the first buckle main body 4 between the bolt 8 and the receptacle 5 is open to the side, FIGS. 20 to 25 show by way of example, in two embodiments, that a cover 32 is additionally present here. A first variant with such a cover is shown in FIGS. 20 to 22, wherein FIG. 21 shows the section along the section line JJ from FIG. 20, and FIG. 22 shows the section along the section line KK from FIG. 20. FIG. 23 shows a second variant with a cover 32, wherein FIG. 24 shows the section along the section line LL and FIG. 25 shows the section along the section line MM from FIG. 23. A common aspect of both variants according to FIGS. 20 to 25 is that they build on the buckle according to FIGS. 1 to 19, and it is therefore only the differences that have to be explained below. The differences lie essentially in the presence and the respective design of the cover 32.

The cover 32 is arranged over the receiving opening 29 or the first buckle main body 4 such that an insertion slit 33 remains through which the hook-in part 7 of the second buckle part 3 can be inserted into the receiving opening 29 and can be removed again from the latter. The rest of the hooking and unhooking procedure and of the locking and unlocking procedure corresponds to what has been explained above. In the variant according to FIGS. 20 to 22, the bolt 8 is guided through a corresponding opening in the cover 32, such that it is possible to press directly on the bolt 8 in order to bring the latter from its locking position to the unlocking position.

In the variant according to FIGS. 23 to 25, this is not the case. In this variant, the bolt 8 is concealed under a tongue 34 of the cover 32. Here, however, the tongue 34 is mounted in a deflectable manner on the rest of the cover 34 in such a way that, by pressing on the tongue 34, pressure is applied automatically to the bolt 8 in order to bring the latter from the locking position to the unlocking position. For this purpose, the tongue 34 is mounted pivotably on the cover 32.

Figure 26:
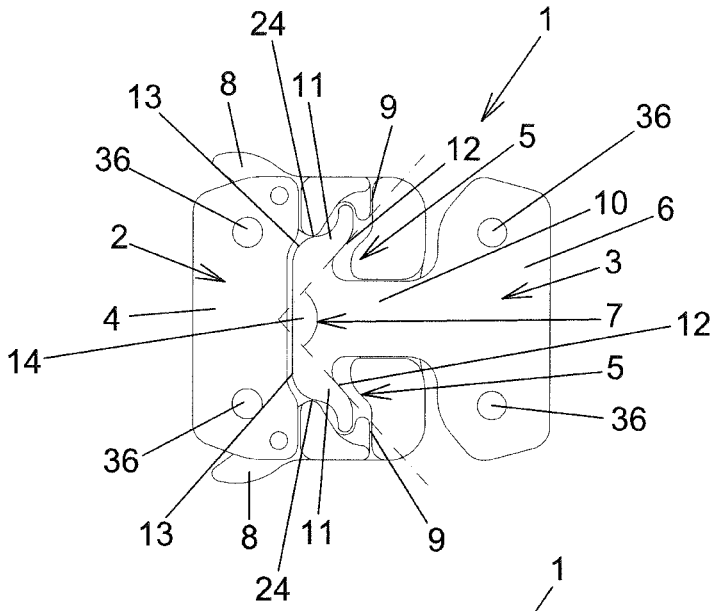
FIGS. 26 to 28 show an additional illustrative embodiment.
Figure 27:
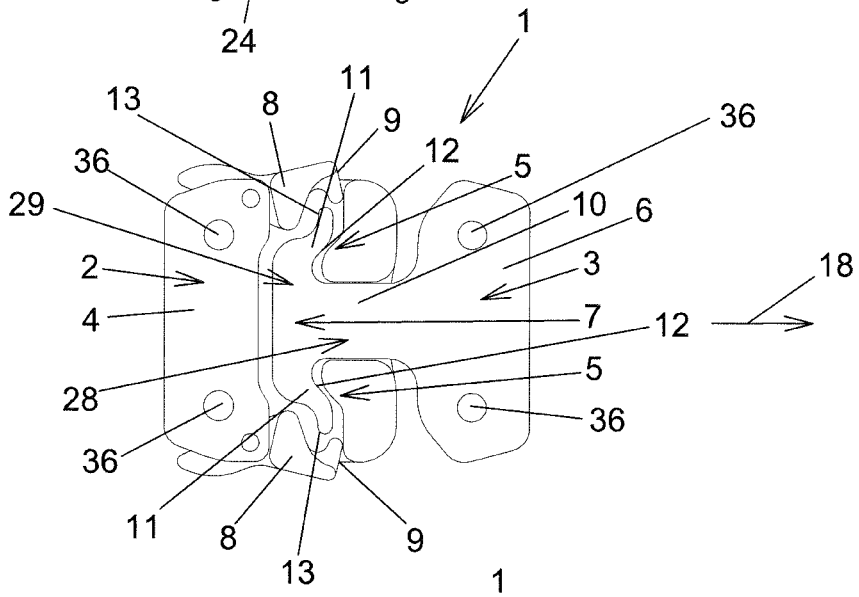
Figure 28:
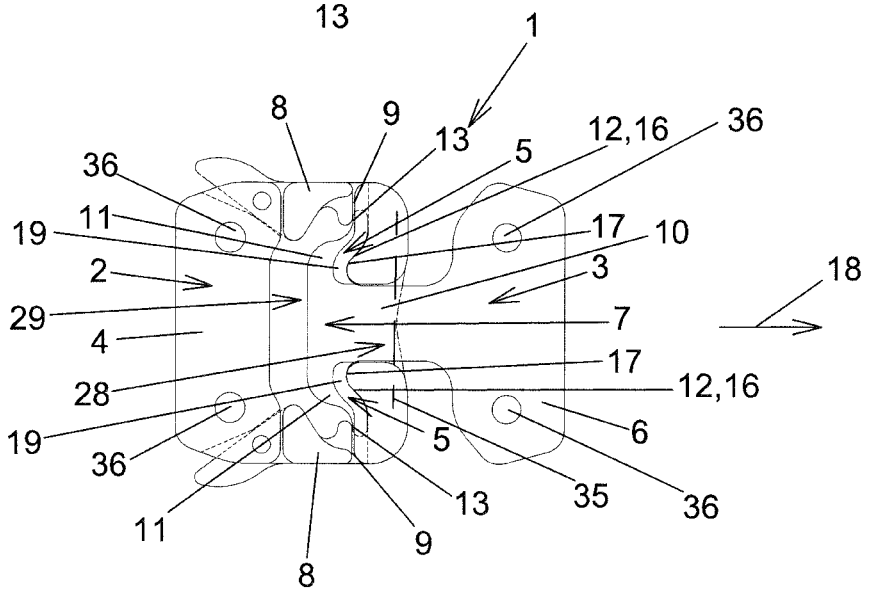

FIGS. 26 to 28 show a further illustrative embodiment of a buckle 1 according to the invention. This illustrative embodiment serves above all to explain other design options of the invention that are shown by way of example. The differences from the buckles 1 discussed hitherto can be realized individually and/or in combination. The illustrative embodiment according to FIGS. 26 to 28 is likewise a buckle 1 with a first buckle part 2 and a second buckle part 3, wherein the first buckle part 2 has a first buckle main body with a receptacle 5 which is hook-shaped, seen in at least one section, and formed rigidly on the first buckle main body 4. The hook-shaped design of the receptacle 5 cannot itself be seen in FIGS. 26 to 28. However, it can be formed analogously to the depictions in FIG. 4, such that the receptacle 5 has two side walls 19 which between them delimit a receiving opening for receiving the front edges 12 of the side parts 11 and, if appropriate, also further regions of the side parts 11 of the hook-in part 7. In this illustrative embodiment too, the hook-in part 7 for hooking into this receptacle 5 on the second buckle main body 6 is inherently rigid. In the hooked-in and locked state, the side walls 19 prevent a lateral tilting of the hook-in part 7 out of the receptacle 5, e.g. when the second buckle part 3 is subjected to a torque about the axis 35 relative to the first buckle part 2.

In the variant shown here, for explanatory purposes, two bolts 8 are present which are designed as levers mounted pivotably on the first buckle main body 4 and which each have a retaining surface 9. In the state when hooked into the receptacle 5, the hook-in part 7 is retained, in the locking position of the respective bolt 8, by the retaining surface 9 of the respective bolt 8, since the respective retaining surfaces 9 each form an abutment for the respective rear edge 13 of the side parts 11 of the hook-in part 7.

FIG. 28 shows the hook-in part 7 in the state when hooked into the receptacle 5, wherein the bolts 8 are located in the locking position and, therefore, their retaining surfaces 9, by interaction with the rear edges 13 of the side parts 11, secure the hook-in part 7 in the hooked-in state in the receptacle 5. FIG. 26 shows an unlocked state, in which the hook-in part 7 is also not yet hooked into the receptacle 5. In FIG. 26, the hook-in part 7 is inserted only into the receiving opening 29. In this illustrative embodiment, this insertion and alignment of the hook-in part 7 is effected by centering surfaces 24 formed directly in this variant on the bolts 8, which centering surfaces 24, here in this illustrative embodiment, likewise interact with the rear edges 13 of the side parts 11. FIG. 27 shows the outwardly pivoted bolts 8, which are thus located in the unlocking position, such that the hook-in part 7 can be hooked with its side parts 11 and its central web 10 into the respective regions of the receptacle 5, by means of the second buckle part 3 being pulled relative to the first buckle part 2 in pulling direction 18, such that the side parts 11 can penetrate with their front edges 12 into the regions of the receptacle 5 arranged laterally with respect to the central channel 28. In these variants, the bolts 8 are also preferably elastically pretensioned in the direction toward their locking position according to FIG. 28. When the hook-in part 7 is pulled sufficiently far into the receptacle 5 by pulling in pulling direction 18, it then suffices to let go of the bolts 8 such that they automatically move to their locking position according to FIG. 28. In this illustrative embodiment too, by suitable configuration of the outer ends of the side parts 11 and of the corresponding regions of the bolts 8, provision is made that, starting from FIG. 26, it suffices to pull the second buckle part 3 in pulling direction 18 in order to bring about the hooked-in and locked state according to FIG. 28 without separate manual actuation of the bolts 8.

On the basis of this illustrative embodiment according to FIGS. 26 to 28, it is also shown by way of example that the buckle 1 does not necessarily have to be a belt buckle. Thus, in this illustrative embodiment according to FIGS. 26 to 28, fastening holes 36 are provided here instead of the belt-receiving slots 27 and the belt webs 26 on both buckle parts 2 and 3, which fastening holes 36 can serve to fasten the first buckle part 2 and the second buckle part 3 on a corresponding object, e.g. by screwing, riveting or the like. Of course, belts can also be screwed or riveted onto the fastening holes 36. It will be noted generally that both the belt webs 26 and the belt-receiving slots 27 and also the fastening holes 36 are merely examples of different possibilities for fastening or in other words possibilities for connection to the buckle parts 2 and 3, in order to be able to fasten these to other objects.

Also in this illustrative embodiment according to FIGS. 26 to 28, provision is made according to the invention that the hook-in part 7 has a central web 10 and two side parts 11 protruding on mutually opposite sides from the central web 10, wherein each of the side parts 11 is delimited by a respective front edge 12, and the front edges 12 of the side parts 11 are oriented running obliquely away from each other from the direction of the central web. Here too, the side parts 11 together form a dovetail shape. In this illustrative embodiment, the regions of the front ends 12 running obliquely away from each other here enclose an angle 14 of ca. 100°. In contrast to the illustrative embodiments described above with reference to FIGS. 1 to 25 in which the front edges 12 of the side parts 11 run obliquely away from each other counter to the pulling direction 18, FIGS. 26 to 28 show by way of example that the front edges 12 of the side parts 11 can also be oriented running obliquely away from each other at least regionally in the pulling direction 18. In other words, seen from the fastening holes 36 or the belt webs 26 of the second buckle part 3, these front edges 12 or their regions can be oriented running obliquely away from each other either in the direction toward the fastening holes 36 or belt webs 26 or also in the opposite direction.

A further difference, shown here by way of example, from the first design variants is that, in the illustrative embodiment according to FIGS. 26 to 28, the entire front edges 12 of the side parts 11 form contact shoulders 16 which, in the hooked-in and locked state and upon pulling in pulling direction 18, transmit forces to the corresponding mating contact shoulders 17 of the first buckle part 2 in pulling direction 18. Thus, in this embodiment variant, the free spaces 31 are dispensed with, for example. Of course, this could also be suitably modified such that once again only subregions of the front edges 12 of the side parts 11 form the contact shoulders 16, and corresponding free spaces 31 are present in the other regions. In FIG. 28, the receptacle 5 is at any rate shown in an almost transparent form, so that it is possible to see how the side parts 11 have penetrated, in particular with their front edges 12, into the corresponding regions of the receptacle 5.

FIGS. 29 to 35 show a further illustrative embodiment of the invention. This illustrative embodiment according to FIGS. 29 to 35 again has many points in common with the first illustrative embodiment according to FIGS. 1 to 19, and therefore, in order to avoid repetition, reference is initially made generally to the above description of this first illustrative embodiment. The following focuses mainly on the differences from the first illustrative embodiment.

Figure 29:
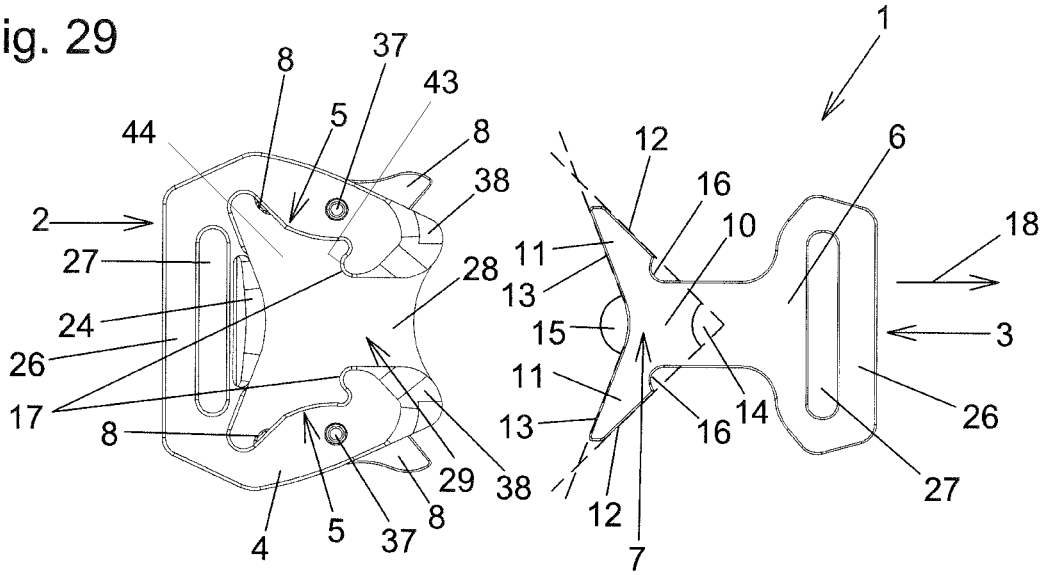
FIGS. 29 to 35 show a further additional illustrative embodiment.

FIG. 29 shows the first buckle part 2 and the second buckle part 3 separate from each other, with the first buckle part 2 including the receptacle 5 defined by the rigid wall 43 extending up from the bottom wall 44. It can be clearly seen that, also in this additional illustrative embodiment according to FIGS. 29 to 35, the second buckle part 3 has a second buckle main body 6 with a central web 10 and with side parts 11 protruding from the latter on two opposite sides according to the invention. In this illustrative embodiment too, each of the side parts 11 is delimited by a respective front edge 12, and the front edges 12 of the side parts 11 are oriented running obliquely away from each other at least regionally from the direction of the central web 10. An overall V-shaped structure is also obtained here. The angle 14 here is ca. 90°, and the angle 15 here is ca. 140°. This illustrative embodiment according to FIGS. 29 to 35 is again equipped with belt webs 26 and belt-receiving slots 27. Instead of these, however, fastening holes 36 or the like could of course also be provided in order to fasten the first and second buckle parts 2 and 3 to belts or other objects.

It can also be clearly seen from FIG. 29 that the first buckle main body 4 has a receiving opening 29 with a central channel 28, into which the hook-in part 7 can be inserted with its central web 10 and the two side walls 11 in order to connect the two buckle parts 2 and 3 to each other. FIG. 29 also shows clearly, on the first buckle main body 4, the mating contact shoulders 17 which serve to bear the contact shoulders 16 on the hook-in part 7 of the second buckle main body 6 of the second buckle part 3. FIG. 29 also clearly shows the centering surface 24 serving as insertion aid, and the bevels 38 which are arranged on the first buckle part 2, or its first buckle main body 4, and of which the function is explained further below. An important difference between the illustrative embodiment according to FIGS. 29 to 35 and the first illustrative embodiment lies in the number and the design of the bolts 8. As regards the number, it will be noted that two bolts 8 are present in this illustrative embodiment. The other difference is that these bolts 8 in this illustrative embodiment according to FIGS. 29 to 35 are each designed as a lever that is mounted pivotably on the first buckle main body 4 about a respective pivot pin 37. This can best be seen from the sectional view according to FIG. 35. The latter also clearly shows the pretensioning elements 30, which are here designed as helical springs and pretension each of the bolts 8 in the directions 21 toward their locking position shown in FIG. 35. The result of this is that, if no pressure is exerted on the bolts 8, the bolts 8 are always automatically in the locking position according to FIG. 35. In this locking position according to FIG. 35, the retaining surfaces 9 formed on the respective bolt 8 prevent the two buckle parts 2 and 3 from being able to be separated from each other, since the retaining surfaces 9 act as abutments for the rear edges 13 of the side parts 11 of the second buckle part 3, as a result of which, in the locking position of the bolts 8, the second buckle part 3 is prevented from being separated from the first buckle part 2.

The provision of two bolts 8 instead of just one bolt 8 has the advantage that a redundancy is created. To release the two buckle parts 2 and 3 from each other, both bolts 8 have to be deflected counter to the pretensioning of the respective pretensioning elements 30, in order thereby to release the second buckle part 3 or its hook-in part 7. If, for example by inadvertent actuation, only one of the two bolts 8 is deflected from its locking position, the other bolt 8 then always prevents the two buckle parts 2 and 3 from being separated from each other.

Figure 30:
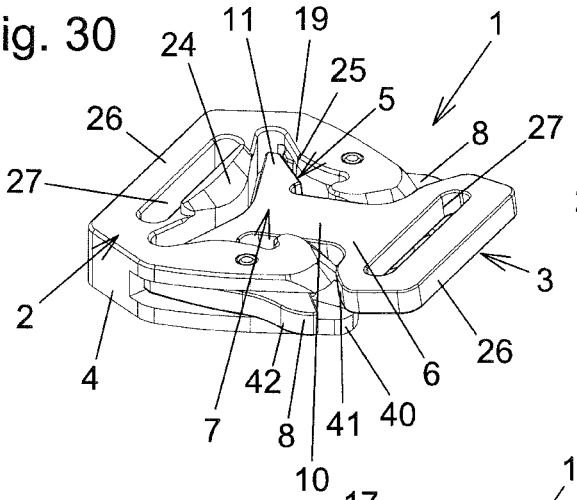
Figure 31:
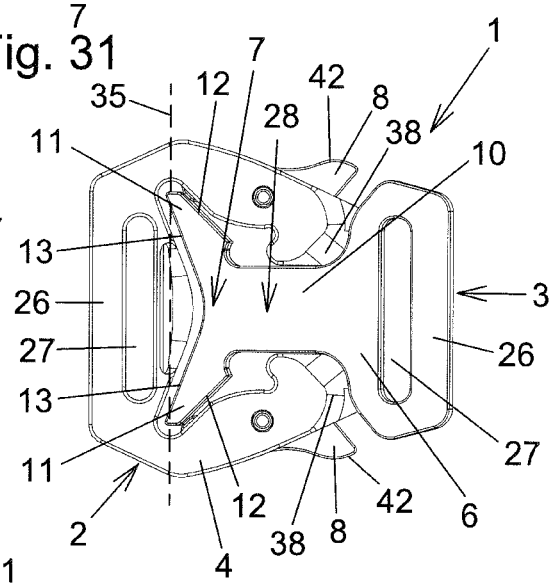
Figure 32:
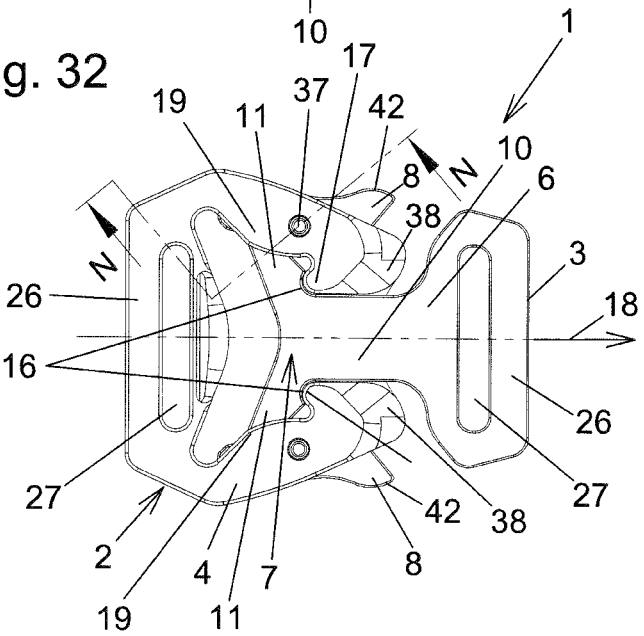
Figure 33:
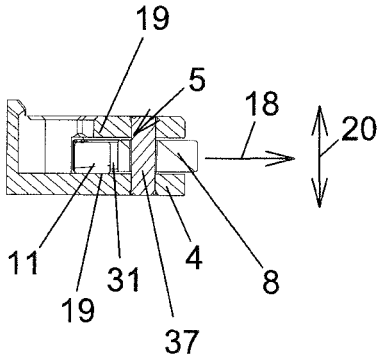
Figure 34:
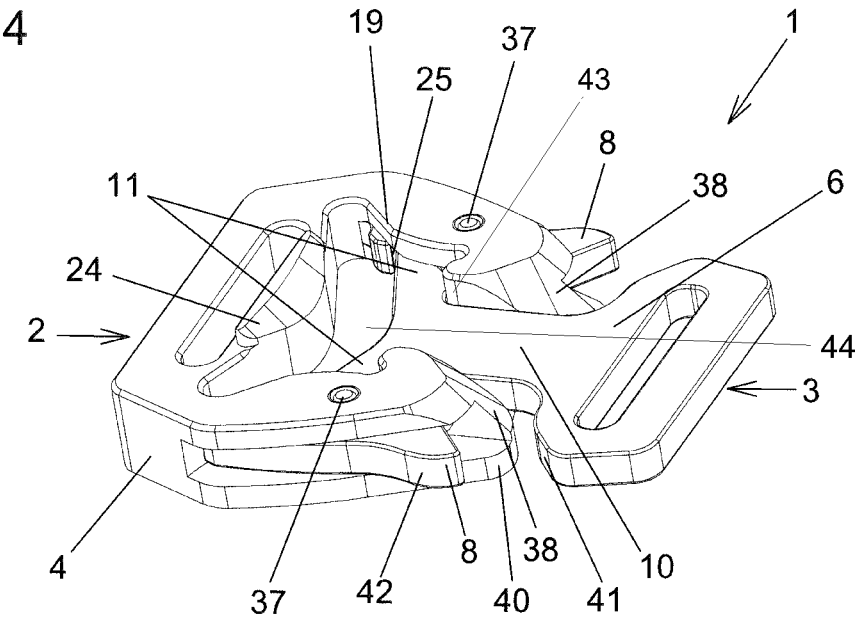

To illustrate the hooking-in procedure explained below, by which the two buckle parts 2 and 3 are connected to each other, FIGS. 30 to 34 are additionally shown. FIGS. 30 and 31 show an intermediate position in the hooking-in procedure. FIGS. 32 to 34 show, like FIG. 35, the fully hooked-in state in which the second buckle part 3 is also locked in the first buckle part 2 by means of the bolts 8, as can be seen from the sectional view in FIG. 35. To hook the second buckle part 3 into the first buckle part 2 starting from FIG. 29, the hook-in part 7 is inserted into the receiving opening 29 in the slightly inclined position that can be seen particularly clearly in FIG. 30, wherein the central web 20 of the second buckle part 3 comes to lie over the central channel 28 of the first buckle part 3 or of the first buckle main body 4. The centering surface 24 on the first buckle main body 4 forms a guide, which interacts with the rear edges 13 of the second buckle part 3 such that the hook-in part 7 of the second buckle part 3 is guided in the correct orientation into the receiving opening 29.

Proceeding from the intermediate position thus reached according to FIGS. 30 and 31, the second buckle main body 6 of the second buckle part 3 is now pivoted downward, i.e. in the direction into the receiving opening 29 or into the central channel 28, about the imaginary axis 35 indicated in FIG. 31. In the process, the second buckle main body 6 slides along the bevel 38 of the first buckle main body 4, such that the second buckle part 3 is automatically displaced in pulling direction 18 relative to the first buckle part 2. In this movement, the front edges 12 of the side parts 11 press against the bevels 39, indicated in FIG. 35, on the bolts 8. This has the effect that the bolts 8 are deflected from the locking position automatically to their unlocking position, i.e. counter to the direction 21, such that the side parts 11 of the hook-in part 7 can be pushed past the ends of the bolts and, at the end of the movement, the end position visible in FIGS. 32 to 35 is reached, in which the two buckle parts 2 and 3 are connected to each other and are locked with the bolts 8. In this end position, the pretensioning elements 30 again ensure that the bolts 8 adopt their locking position shown in FIG. 35, in which the retaining surfaces 9 on the bolts 8 prevent the hook-in part 7 and thus the second buckle part 3 from being able to be displaced counter to the pulling direction 18.

Figure 35:
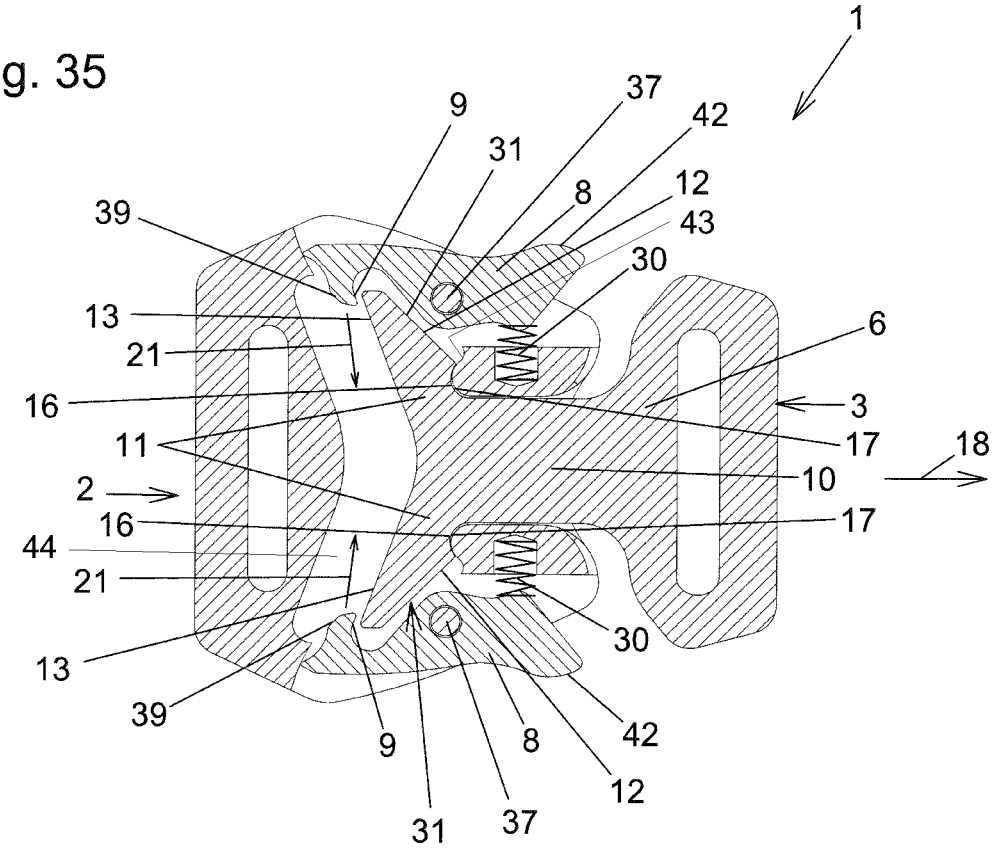

In this locked end position, the second buckle part 3 bears with its contact shoulders 16 on the corresponding mating contact shoulders 17 of the first buckle main body 4. In this hooked-in state, tensile forces acting in the pulling direction 18 are transmitted from the hook-in part 7 to the first buckle main body 4 exclusively via the bearing of the contact shoulders 16 on the mating contact shoulders 17. In FIG. 35, this can also be seen clearly from the fact that, outside the contact shoulders 16, free spaces 31 remain in front of the front edges 12 of the side parts 11 in direction 18. One of these free spaces 31 can also be seen clearly in the section in FIG. 33. The section in FIG. 33 extends along the section line NN from FIG. 32 and thus through one of the receptacles 5 of the first buckle part 2. FIG. 33 shows clearly how the corresponding side part 11 is inserted into the hook-shaped receptacle 5 delimited by the side walls 19 of the first buckle main body 4. In the hooked-in state, the side walls 19 delimiting the receptacle 5 form side abutments for the front edges 12 of the side parts 11 and thus prevent a lateral tilting of the hook-in part 7 out of the receptacle 5 in the directions 20 orthogonal to the pulling direction 18.

Therefore, in this illustrative embodiment according to FIGS. 29 to 35, it is also the case that the tensile forces in direction 18 are transmitted exclusively via the contact shoulders 16 and the mating contact shoulders 17, while lateral tilting of the hook-in part 7 out of the first buckle main body 4 is prevented by means of the side parts 11 inserted into the receptacles 5.

The bevels 25 on the first buckle main body 4, which can be seen in FIGS. 30 and 34, facilitate the insertion of the side parts 11 into the receptacle 5 in the hooking-in procedure explained above.

If the two buckle parts 2 and 3 are to be separated from each other again starting from the hooked-in and locked state shown in FIGS. 32 to 35, pressure first of all has to be applied to the actuation surfaces 42 of the bolts 8, such that the latter are pivoted from the locking position to the release position counter to the pretensioning of the pretensioning elements 30 and thus counter to the respective direction 21. In this way, the retaining surfaces 9 free the rear edges 13 of the hook-in part 7 of the second buckle part 3. The second buckle part 3 can now be displaced relative to the first buckle part 2 counter to the pulling direction 18, until the second buckle part 3 abuts with it mating abutment regions 41 against the abutment regions 40 formed adjacent to the respective bevel 38 on the first buckle part 2. In this displacement, the front edges 12 of the hook-in part 7 are still positively guided between the side walls 19 of the receptacle 5. In order now to be able to actually separate the buckle parts 2 and 3 from each other, the mating abutment regions 41 have to be lifted over the abutment regions 40, which takes place by tilting the second buckle part 3 about the imaginary axis 35. The front edges 12 are mounted with so much play between the side walls 19 that this tilting is possible. In a further displacement of the second buckle part 3 relative to the first buckle part 2 counter to the pulling direction 18, the bevels 38 on the first buckle main body 4 now ensure further tilting of the second buckle part 3 about the imaginary axis 35 to the intermediate position according to FIGS. 30 and 31, wherein the front edges 12 are then moved completely out of the receptacle 5, or the region between the side walls 19. When this intermediate position is reached, the hook-in part 7 and therefore the second buckle part 3 can be removed laterally from the receiving opening 29, such that the two buckle parts 2 and 3 can then be completely separated from each other.

Overall, the invention has made available a buckle 1 which is able to take up high tensile forces but in which inadvertent release of the buckle parts 2 and 3 by lateral tilting relative to each other is safely prevented. Moreover, buckles 1 according to the invention, in particular the last illustrative embodiment of a buckle 1, are readily scalable, such that corresponding buckles 1 can be produced for different belt widths or generally speaking in different sizes.

KEY TO THE REFERENCE NUMBERS

1 buckle
2 first buckle part
3 second buckle part
4 first buckle main body
5 receptacle
6 second buckle main body
7 hook-in part
8 bolt
9 retaining surface
10 central web
11 side part
12 front edge
13 rear edge
14 angle
15 angle
16 contact shoulder
17 mating contact shoulder
18 pulling direction
19 side wall
20 direction
21 direction
22 first step

23 second step
24 centering surface
25 bevel
26 belt web
27 belt-receiving slot
28 central channel
29 receiving opening
30 pretensioning element
31 free space
32 cover
33 insertion slit
34 tongue
35 axis
36 fastening hole
37 pivot pin
38 bevel
39 bevel
40 abutment region
41 mating abutment region
42 actuation surface
43 rigid wall
44 bottom wall

The invention claimed is:

1. A buckle, comprising:

a first buckle part including a first buckle main body and a receptacle which is hook-shaped, as seen in at least one section, and formed rigidly on the first buckle main body;

a second buckle part including a second buckle main body with a hook-in part that is inherently rigid for hooking into the receptacle of the first buckle part;

a bolt on the first buckle part, the bolt having a locking position and an unlocking position, and the hook-in part, in a state when hooked into the receptacle in the locking position of the bolt, is retained in the receptacle by at least one retaining surface of the bolt and, in the unlocking position of the bolt, is removable from the receptacle;

the hook-in part has a central web and two side parts protruding on mutually opposite sides from the central web, and each of the side parts is delimited by a respective front edge, and the front edges of the side parts are oriented running obliquely away from each other at least regionally from a direction of the central web, wherein the side parts of the hook-in part contact a rigid wall of the receptacle that extends up from a bottom wall of the receptacle in a hooked-in position.

2. The buckle according to claim 1, wherein the front edges of the side parts are oriented at least regionally in a V-shape relative to each other.

3. The buckle according to claim 1, wherein the side parts together form a dovetail shape.

4. The buckle according to claim 1, wherein each of the side parts, on a side opposite the respective front edge of the side part, is delimited by a rear edge of the side part, and the at least one retaining surface of the bolt in the locking position forms an abutment surface for the rear edges of the side parts of the hook-in part hooked into the receptacle.

5. The buckle according to claim 4, wherein the rear edges of the side parts are oriented extending obliquely away from each other at least regionally from the direction of the central web.

6. The buckle according to claim 5, wherein the rear edges of the side parts extend at least regionally in a V-shape relative to each other.

7. The buckle according to claim 5, wherein the front edges of the side parts together enclose an angle in an angle range of 20° to 160°, and the rear edges of the side parts together enclose an angle in an angle range of 20° to 160°.

8. The buckle according to claim 1, wherein the front edges of the side parts together enclose an angle in an angle range of 20° to 160°.

9. The buckle according to claim 1, wherein only a subregion of the respective front edge is formed as a contact shoulder on the hook-in part, and corresponding mating contact shoulders are formed on the first buckle main body, and, in the state with the hook-in part hooked in the receptacle, when the hook-in part is pulled in a pulling direction into the receptacle, tensile forces in pulling direction are transmitted from the hook-in part to the first buckle main body exclusively via the contact shoulders bearing on the mating contact shoulders.

10. The buckle according to claim 9, wherein the contact shoulders are each arranged in a half of the respective front edge pointing toward the central web.

11. The buckle according to claim 9, wherein the contact shoulders are in each case directly adjoining the central web.

12. The buckle according to claim 9, wherein the contact shoulders are each formed as an at least regionally rounded undercut.

13. The buckle according to claim 1, wherein, in the state with the hook-in part hooked in the receptacle, side walls of the receptacle of the first buckle main body are side abutments for the front edges of the side parts and prevent lateral tilting of the hook-in part out of the receptacle in a direction orthogonal to the pulling direction.

14. The buckle according to claim 1, wherein the bolt in the first buckle main body is a push button that is displaceable linearly between the locking position and the unlocking position, and the bolt is elastically pretensioned in a direction toward the locking position.

15. The buckle according to claim 1, wherein the bolt has a stepped shape, and includes a first step of the bolt that has the at least one retaining surface for the hook-in part in the locking position, and a second step of the bolt, offset with respect to the first step, that has at least one centering surface for centering the hook-in part during insertion of the hook-in part into the receptacle.

16. The buckle according to claim 1, further comprising bevels formed on at least one of the front edges of the side parts or on side walls of the first buckle main body that form the receptacle, the bevels act as an insertion aid for insertion of the hook-in part into the receptacle.

* * * * *